US011629565B1

(12) United States Patent
Wai

(10) Patent No.: US 11,629,565 B1
(45) Date of Patent: Apr. 18, 2023

(54) DOWNHOLE TRACTOR WITH WHEEL ASSEMBLY

(71) Applicant: Halliburton Energy Services, Inc., Houston, TX (US)

(72) Inventor: Simon Whye Kwong Wai, Singapore (SG)

(73) Assignee: Halliburton Energy Services, Inc., Houston, TX (US)

( * ) Notice: Subject to any disclaimer, the term of this patent is extended or adjusted under 35 U.S.C. 154(b) by 70 days.

(21) Appl. No.: 17/514,217

(22) Filed: Oct. 29, 2021

(51) Int. Cl.
*E21B 23/00* (2006.01)

(52) U.S. Cl.
CPC ..... *E21B 23/001* (2020.05)

(58) Field of Classification Search
CPC . E21B 23/001; B60B 15/026; B60B 11/0311; B60B 11/0316; B60B 15/00; B60C 11/113; B60C 2011/0381; B60C 11/032
See application file for complete search history.

(56) References Cited

U.S. PATENT DOCUMENTS 3,467,159 A * 9/1969 Emmetv ..... B60C 11/0316 152/209.12
D699,267 S * 2/2014 Nelson ..... D15/28
9,157,287 B2 * 10/2015 Slocum ..... E21B 4/18
11,047,190 B2 * 6/2021 Saint Germain ..... E21B 41/00
2010/0012315 A1 * 1/2010 McInally ..... E21B 23/14 166/241.5
2014/0014368 A1 * 1/2014 Hallundb ..... E21B 23/04 166/381
2014/0174760 A1 6/2014 Slocum et al.

FOREIGN PATENT DOCUMENTS

CN 105672987 A 6/2016
WO 2020041147 A1 2/2020
WO 2020159552 A1 8/2020

OTHER PUBLICATIONS

International Search Report and Written Opinion dated Jul. 11, 2022 for corresponding PCT patent application No. PCT/US2021/057270 filed on Oct. 29, 2021.

* cited by examiner

*Primary Examiner* — D. Andrews
*Assistant Examiner* — Ronald R Runyan
(74) *Attorney, Agent, or Firm* — K&L Gates LLP

(57) ABSTRACT

A downhole tractor assembly operable in a wellbore that includes a tractor body and a tractor wheel assembly. The tractor wheel assembly includes a tractor wheel with teeth around a circumference of the wheel and grooves between adjacent teeth. The grooves include a profile in a plane parallel with the axis of the wheel. Also, each tooth includes an outer face with face grooves on each side of the outer face that extend less than across the wheel.

20 Claims, 5 Drawing Sheets

DOWNHOLE TRACTOR WITH WHEEL ASSEMBLY

BACKGROUND

This section is intended to provide relevant background information to facilitate a better understanding of the various aspects of the described embodiments. Accordingly, these statements are to be read in this light and not as admissions of prior art.

In well bores that include horizontal sections and horizontal landing sections, logging tools, perforating devices, bridge plugs, and other well interventions tools need to be connected to a downhole tractor so that the tool or device can be transported to a location in the wellbore. The range of a tractor and the amount of payload that can be conveyed are determined by the tractor's ability to provide sufficient traction between the wheels and a wall of the wellbore. The higher the traction, the longer the range and the larger amount of payload will be. Often, the traction for open hole wellbore applications is low due to the presence of debris such as mud, sand, metal chips, etc. within the wellbore. As the wheels of the tractor rotate, debris will accumulate and adhere to the wheel surfaces. This will reduce the grip capability of the wheels and the traction will drop significantly

BRIEF DESCRIPTION OF THE DRAWINGS

Embodiments of the downhole tractor with wheel assembly are described with reference to the following figures. The same or sequentially similar numbers are used throughout the figures to reference like features and components. The features depicted in the figures are not necessarily shown to scale. Certain features of the embodiments may be shown exaggerated in scale or in somewhat schematic form, and some details of elements may not be shown in the interest of clarity and conciseness.

DETAILED DESCRIPTION

Figure 1:
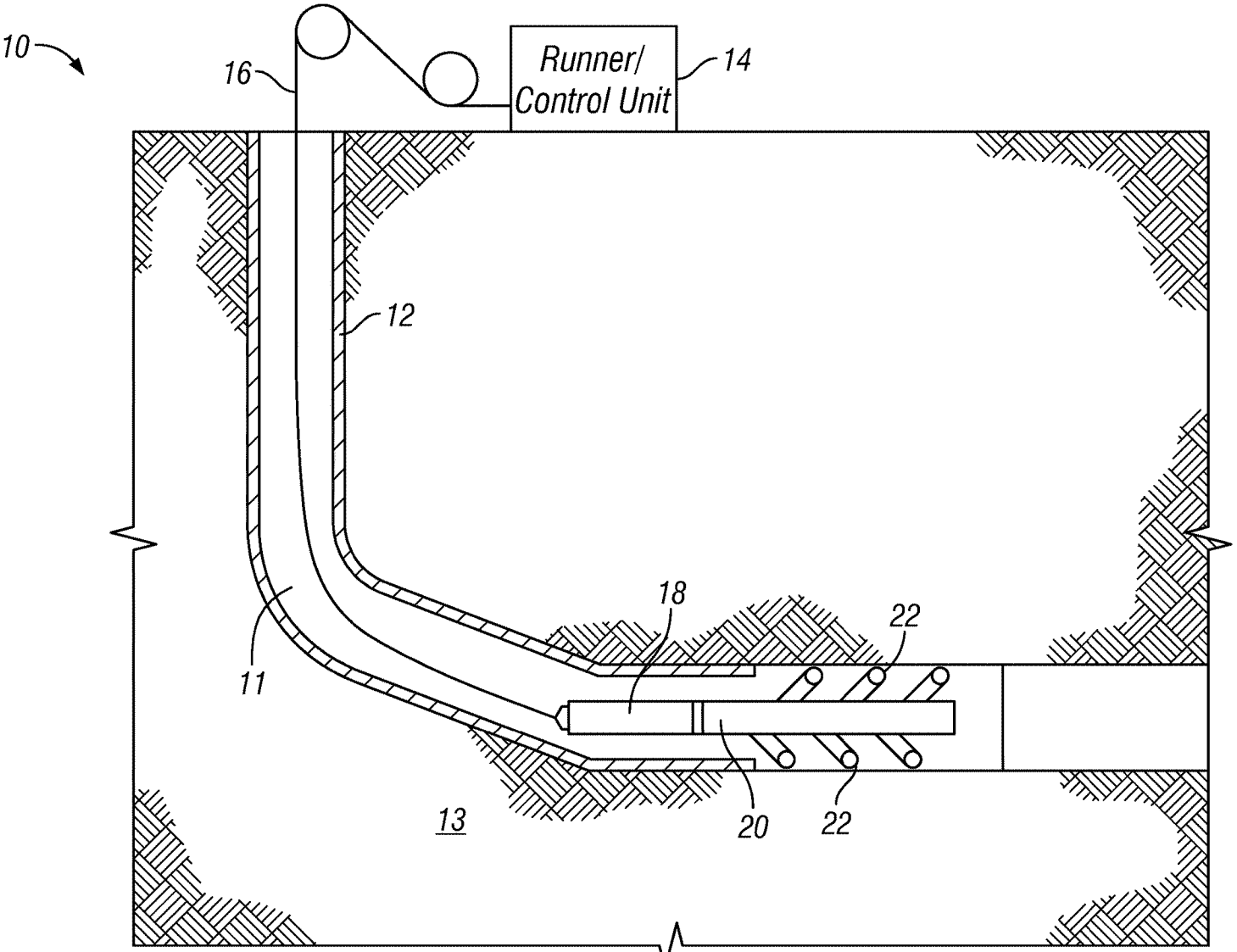
FIG. 1 is an illustration of a wellsite and control system utilizing a downhole tractor.

The present disclosure relates, in general, to downhole tractors used in wellbores and, in particular, to downhole tractors and tractor wheels.

The systems, devices, and methods presented herein maintain traction of downhole tractors to achieve a longer tractoring distance and an increased payload capacity when used for running tools or devices downhole into a well bore. These systems, devices, and methods describe a tractor wheel having a wheel tooth geometry that enhances traction with casing wall to propel the tractor. The traction of the tractor wheels is complemented by the actuation of an actuator or actuators that control the position of the tractor wheels. In wellbore applications, the tractor may be employed to convey equipment along an open wellbore, along the interior of a casing, and/or along the interior of another tubular structure.

The wheels of the tractor include a plurality of teeth on the circumference. Arced grooves that are parallel to the wheel axis are made in between adjacent teeth. Each tooth includes an outer face including face grooves on each side of the outer face and that extend less than across the wheel. Conveyance is achieved when the wheels rotate and push against the wellbore. The contact force from the wellbore will channel debris in the wellbore out from the wheel via the grooves and the face grooves. This will prevent the accumulation of debris over the wheel surfaces and increase the tractoring distance and the payload capacity of the tractor. In addition, the teeth outer faces enable a low contact stress between the wheel and wellbore wall. The low contact stress ensures that the wheel will grip onto the formation without damaging the formation.

In certain embodiments, the wheel may comprise an outer diameter of about 2 inches (about 50 mm) to about 3.5 inches (about 90 mm), or about 2 inches (about 50 mm) to about 3 inches (about 75 mm), or about 3 inches (about 75 mm) to about 3.5 inches (about 90 mm), and/or any value or range of values therein. The wheel may be of any suitable width for a given application. Suitable wheel widths may include, but are not limited to, about 0.125 inches (about 3 mm) to about 0.75 inches (about 19 mm), or about 0.125 inches (about 3 mm) to about 0.5 inches (about 13 mm), or about 0.5 inches (about 13 mm) to about 0.75 inches (about 19 mm), and/or any value or value of ranges therein. The wheel may comprise a substrate and tread.

Any suitable substrate capable of withstanding downhole temperatures and pressure may be used and the disclosed apparatus is not limited to any particular material for the substrate. In certain embodiments, the substrate may comprise a metal, a metal alloy, the like, or any combination of these materials. As used herein, the term "metal alloy" may refer to a mixture of two or more elements, wherein at least one of the elements is a metal. The metal or metal alloy may be selected from the group consisting of beryllium, aluminum, tin, titanium, vanadium, chromium, manganese, iron, cobalt, nickel, copper, tantalum, tungsten, graphite, carbon, silicon, boron nitride, magnesium, rare earth elements, oxides of any of the foregoing, derivatives thereof, the like, or any combinations of these materials.

Referring to FIG. 1, illustrated is a well site 10 utilizing a downhole system 15 comprising a downhole tractor assembly 20 for well site intervention or other operations, in accordance with one or more embodiments. The well site 10 includes well casing 12 within a wellbore 11 within a formation 13. The illustrated wellbore 11 is a deviated wellbore that is formed to extend from a surface to a subterranean zone including the formation 13 (e.g., a hydrocarbon bearing geologic formation) and includes a vertical portion, a radius portion, and a horizontal portion. Although portions are referred to as "vertical" and "horizontal," respectively, it should be appreciated that such wellbore portions may not be exactly vertical or horizontal, but instead may be substantially vertical or horizontal to account for drilling operations.

The downhole system 15 includes the downhole tractor assembly 20 coupled by a downhole tool 18 and a length of wireline 16 to a control unit 14. The downhole tractor assembly 20 includes adjustable tractor wheels 22. The tractor wheels 22 engage with the casing 12 or the wall of the wellbore 11 and have a tread that improves traction so that the tractor assembly 20 can more effectively traverse the casing 12 when tractoring non-vertically. Electrical power and control signals to and from the downhole tractor assembly 20 are transmitted via the wireline 16, which includes, for example, a single-strand or multi-strand conductor that is run through the wireline 16 downhole to the downhole tractor assembly 20. In some embodiments, the wireline 16 may be an electrical cable to lower tools (e.g., the downhole tractor assembly 20 and/or other downhole tool) into the wellbore 11 and to facilitate the transmission of power and data. The wireline 16, in some embodiments, may be a conductor for electric logging and cables incorporating electrical conductors. In certain embodiments, data may be transmitted to control unit 14 for storage and further processing.

The control unit 14 may include any instrumentality or aggregate of instrumentalities operable to compute, classify, process, transmit, receive, retrieve, originate, switch, store, display, manifest, detect, record, reproduce, handle, or utilize any form of information, intelligence, or data for business, scientific, control, or other purposes. For example, the control unit 14 may be a personal computer, a network storage device, or any other suitable device and may vary in size, shape, performance, functionality, and price. The control unit 14 may include random access memory (RAM), one or more processing resources such as a central processing unit (CPU) or hardware or software control logic, ROM, and/or other types of nonvolatile memory. Additional components of the control unit 14 may include one or more disk drives, one or more network ports for communication with external devices as well as various input and output (I/O) devices, such as a keyboard, a mouse, and a video display. The control unit 14 may also include one or more buses operable to transmit communications between the various hardware components.

The present disclosure may be implemented at least in part with non-transitory computer-readable media. Non-transitory computer-readable media may include any instrumentality or aggregation of instrumentalities that may retain data and/or instructions for a period of time. Non-transitory computer-readable media may include, for example, without limitation, storage media such as a direct access storage device (e.g., a hard disk drive or floppy disk drive), a sequential access storage device (e.g., a tape disk drive), compact disk, CD-ROM, DVD, RAM, ROM, electrically erasable programmable read-only memory (EEPROM), and/or flash memory; as well as communications media such wires, optical fibers, microwaves, radio waves, and other electromagnetic and/or optical carriers; and/or any combination of the foregoing.

Electrical and hydraulic power subs may also be included in the downhole tractor assembly 20 and may deliver electrical and hydraulic power to various portions of the downhole tractor assembly 20. A lower coupling sub of the downhole tractor assembly 20, as illustrated, is coupled to a downhole tool 18, which may be, for example, a shifting tool, a logging tool, an explosive tool (e.g., a perforating gun or otherwise), a packer, or other type of downhole tool, or other payload.

The downhole tractor assembly 20 may comprise a body that comprises a tubular housing that may be subdivided into various subs, at least one of which includes one or more wheels 22 and another that is a coupling sub to connect to the wireline 16. In one or more embodiments, the downhole tool 18 may be coupled to the tubular housing. Any suitable downhole tool 18 may be coupled to the tubular housing and should not be limited herein. Suitable downhole tools 18 may include, but are not limited to, a shifting tool, an explosive tool, a logging tool, a packer, the like, and/or any combination thereof. Although six wheels 22 are illustrated in FIG. 1, the downhole tractor assembly 20 may include any suitable number of wheels 22 and should not be limited herein. One or more wheels 22 may be powered wheel assemblies for propelling the downhole tractor assembly 20 through the wellbore 11 in order to run the wireline 16 into the wellbore 11. Other wheels 22 or wheel assemblies of the downhole tractor assembly 20 may not be powered but instead be freely rotatable in contact with the wellbore 11 (or casing as appropriate) during operation of the downhole tractor assembly 20.

Figure 2A:
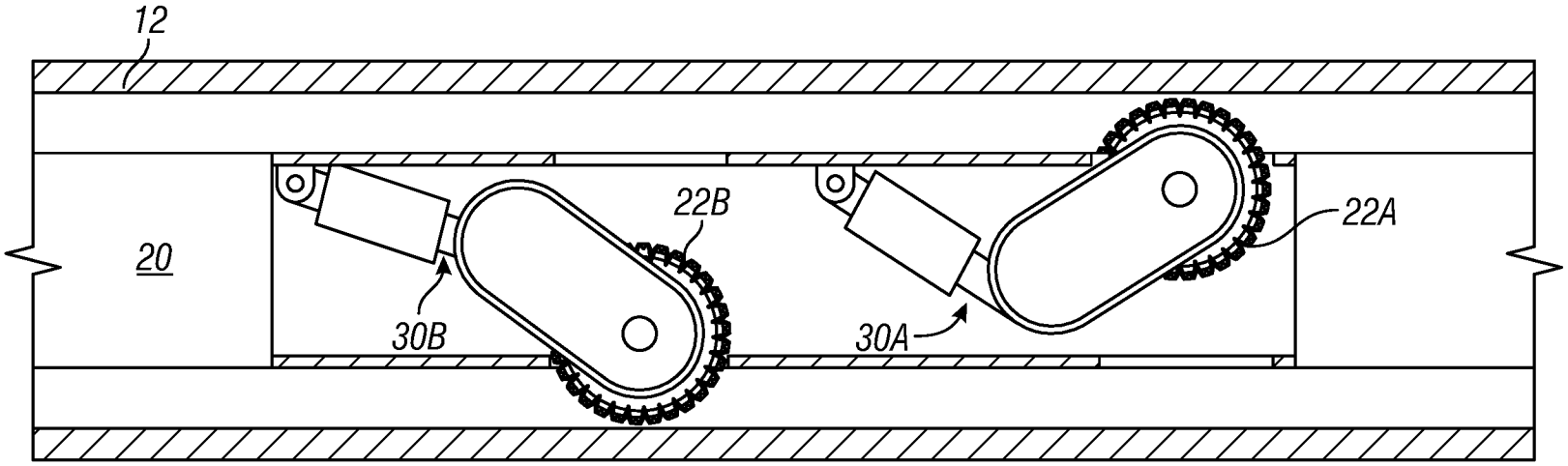
FIGS. 2A and 2B are illustrations of tractor wheel assemblies of the downhole tractor.
Figure 2B:
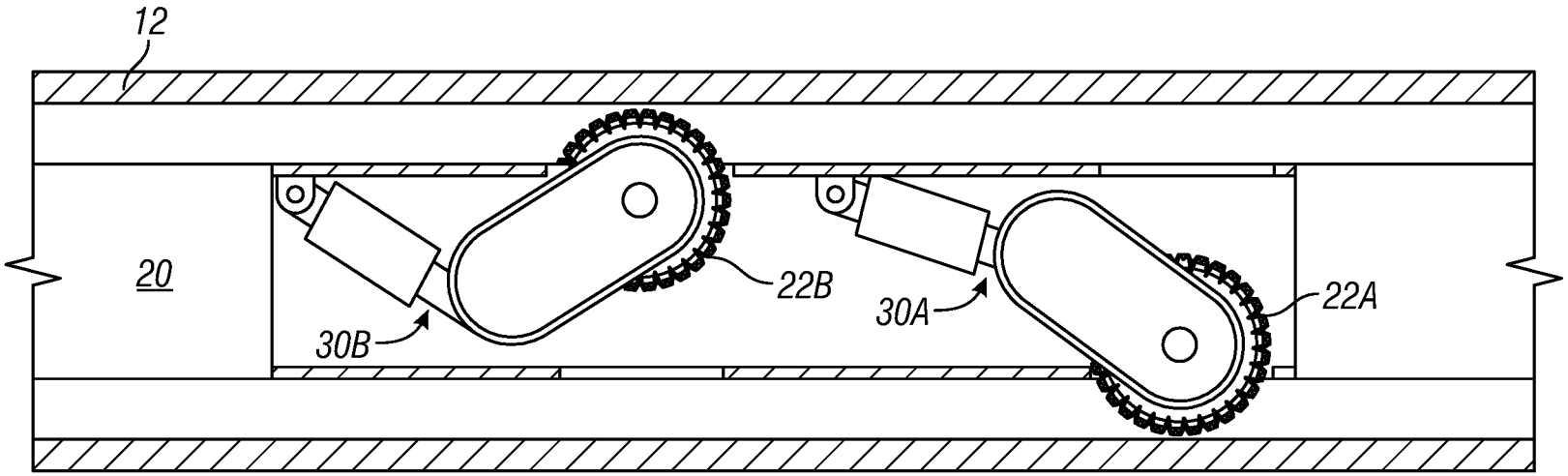
Figure 3A:
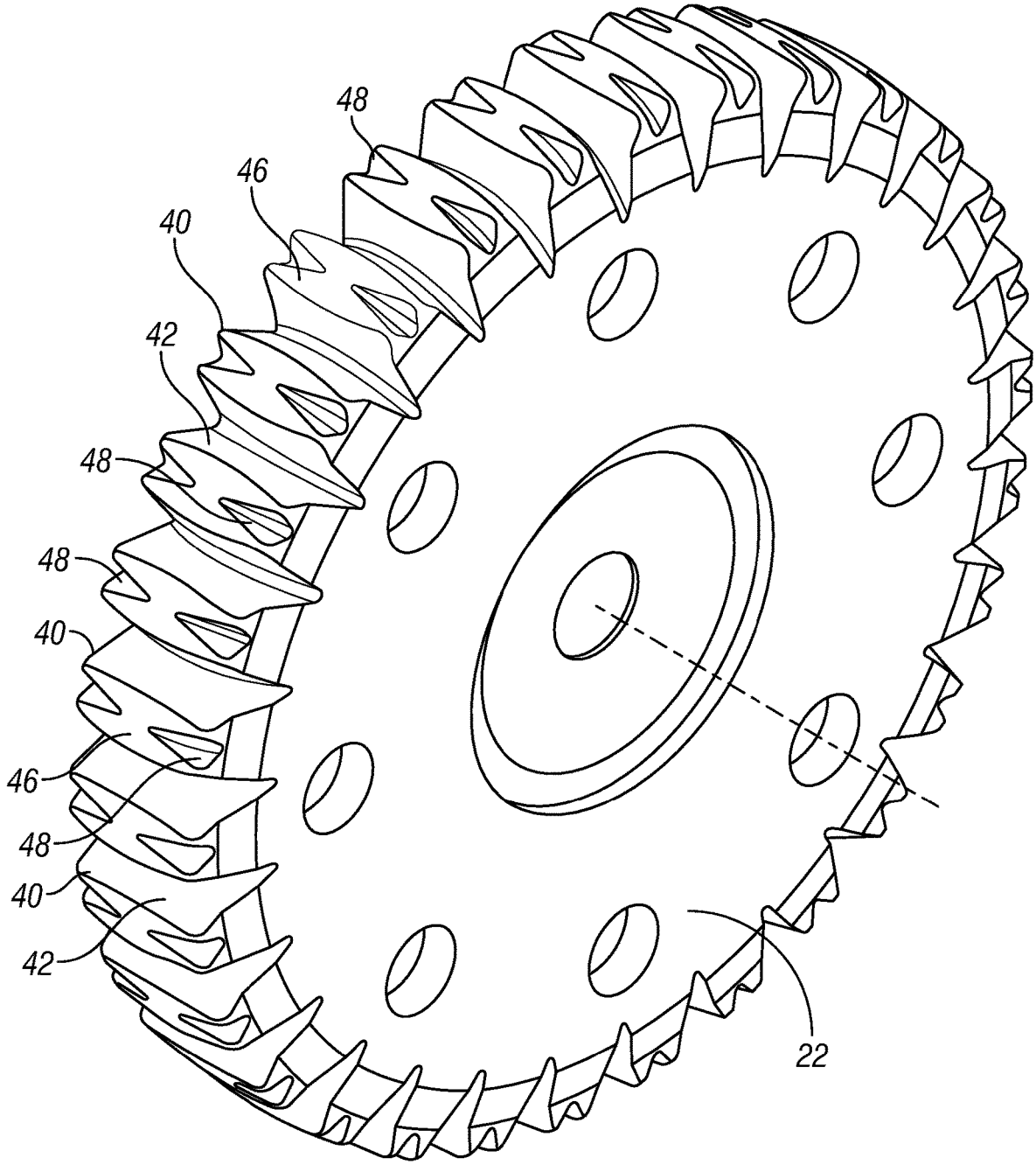
FIGS. 3A-3D are illustrations of a tractor wheel of the tractor wheel assembly.
Figure 3B:
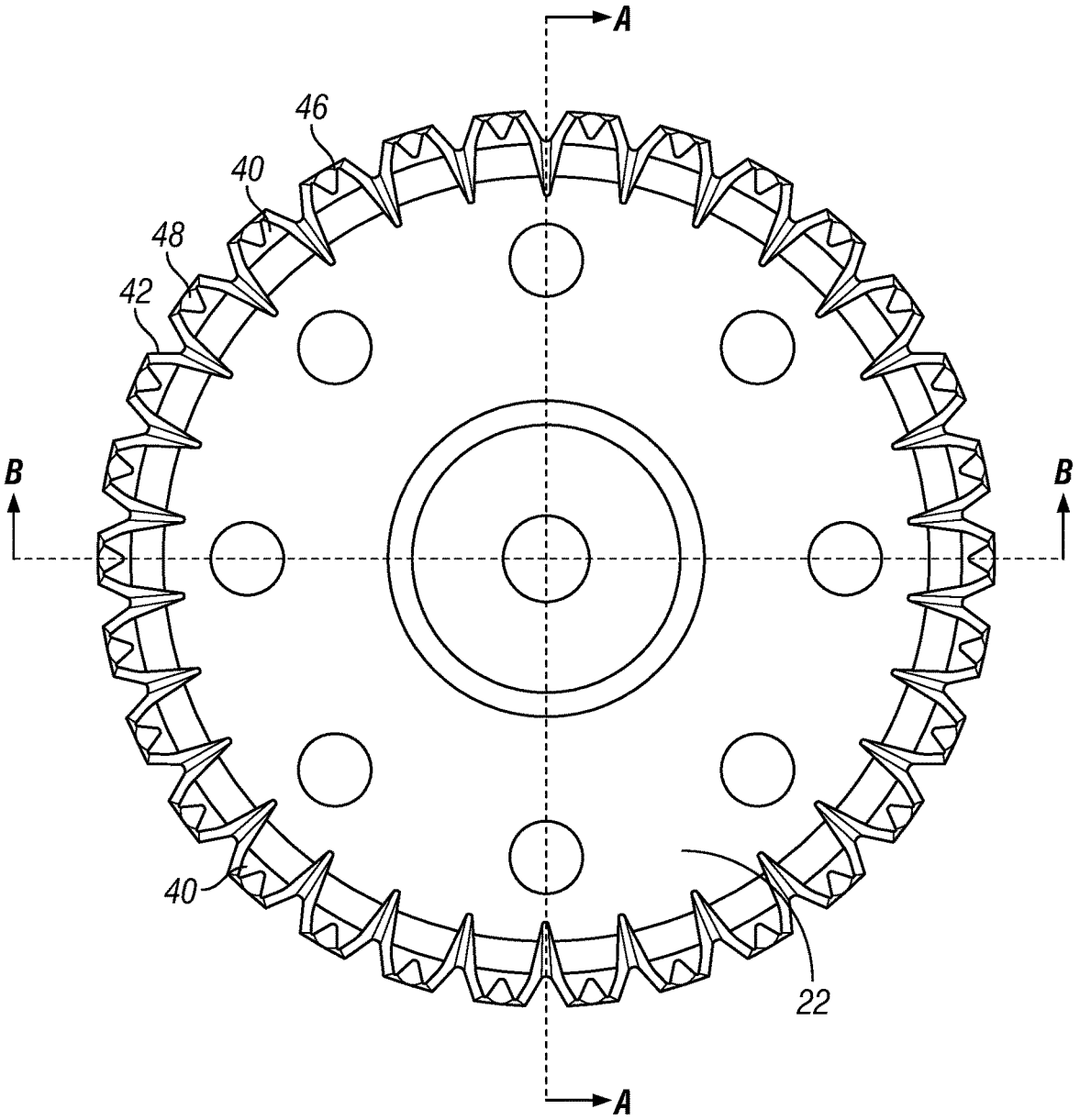
Figure 3C:
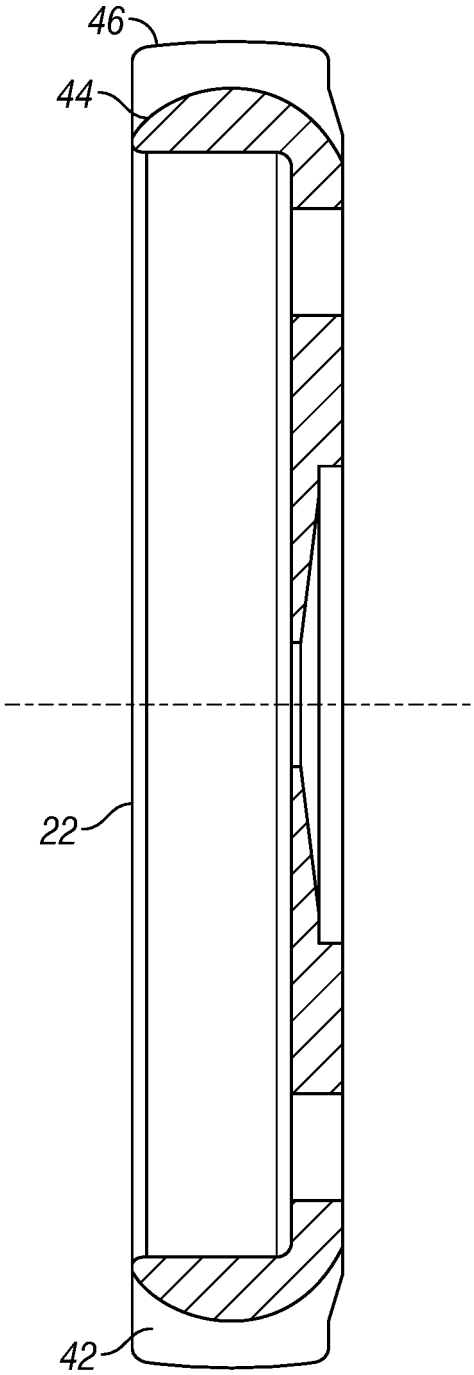
Figure 3D:
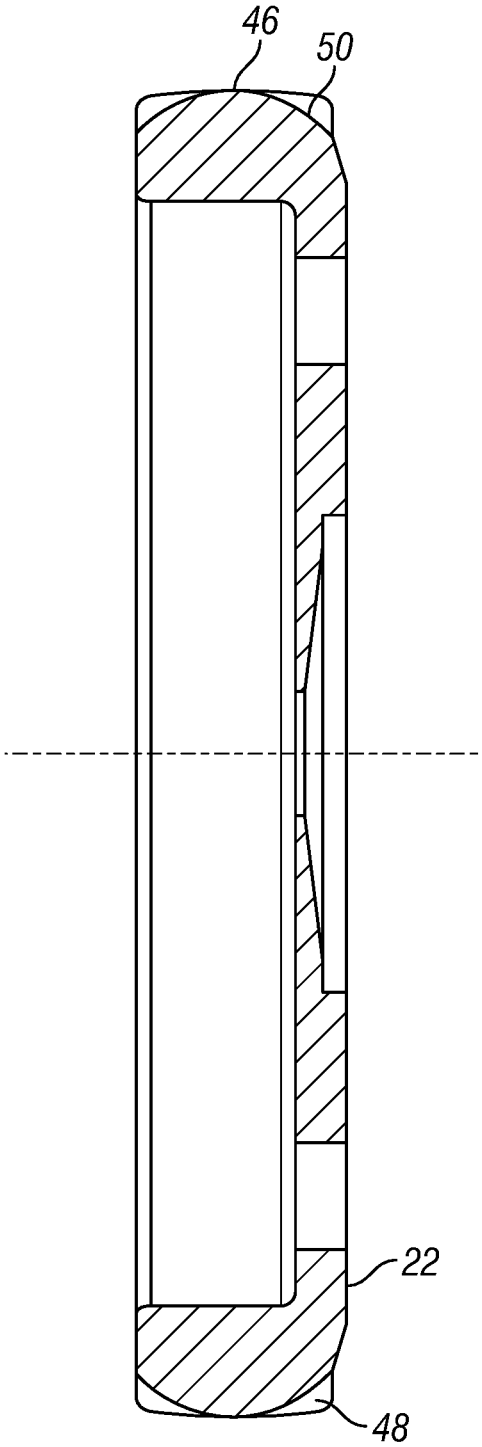

Referring now to FIGS. 2A and 2B, illustrated are tractor wheel 22A and 22B and actuator assemblies 30A, 30B, in accordance with one or more embodiments. Assemblies 30A, 30B can include actuators and actuator arms coupled to the tractor wheels 22A and 22B. The reciprocation of the tractor wheels can be responsive to any type of actuator, e.g. hydraulic, pneumatic, or electric. The actuator assemblies 30A, 30B can be activated by the control unit 14 either through power and control lines run with the wireline 16 or wirelessly. In addition, the actual number of tractor wheels 22A and 22B per downhole tractor assembly 20 can vary depending on requirements. It should also be understood that one actuator could be used to move multiple wheels. The actuator assemblies 30A, 30B are actionably coupled to the wheels 22A, 22B and the tractor body to extend and retract the wheels 22A, 22B.

Referring now to FIGS. 3A-3D, illustrated is tractor wheel 22, in accordance with one or more embodiments. The tractor wheel 22 includes a geometry that improves the traction of the downhole tractor assembly 20. The wheel 22 includes a plurality of teeth 40 on the circumference of the wheel 22. Grooves 42 that are parallel to the wheel axis are made in between adjacent teeth 40. As shown, the grooves 42 are v-shaped grooves. However, other shapes of grooves may be used as well.

In a plane parallel to the axis of rotation of the wheel 22, the grooves 42 may include a profile 44 at the bottom of each groove 42. The profiles 44 may be, for example, an arced profile that include an arc with, for example, the smallest radius of curvature that allows the grooves 42 to extend across the width of the wheel 22. The grooves 42 and the profiles 44 assist in collecting and channeling debris away from the wheel 22 during rotation of the wheel 22 in use. However, it should be appreciated that the grooves 42 may include profiles other than an arced profile and that different grooves 42 on the same wheel may include different profiles.

Each tooth 40 includes an outer face 46 that includes pairs of face grooves 48, with each face groove 48 being on each side of the outer face 46 and that extend less than across the width of the wheel 22. Each outer face 46 includes an area contact engageable with a wall of the wellbore 11. Each pair of the face grooves 48 is formed by an arced profile 50 in a plane parallel with the axis of the wheel 22 that extends past the outer face 46 such that the face grooves extend less than across the width of the wheel 22. Like the grooves 42 between adjacent teeth 40, the face grooves 48 are shaped to channel debris out from the wheel 22 as the wheel 22 rotates against a wall of the wellbore 11.

In use, the downhole tractor 20 conveys in the wellbore 11 by using the actuator assemblies 30A, 30B to extend the wheels 22 into engagement with a wall of the wellbore 11 to grip the wall. The wheel or wheels 22 are rotated and the outer faces 46 of the teeth 40 around the circumference of the wheel and engage the wall of the wellbore 11 and covey the downhole tractor 20 within the wellbore 11. The grooves 42 between the teeth 40 displace debris, as the wheel 22 rotates, out from the wheel 22. The face grooves 48 on each outer face 46 also displace debris, as the wheel rotates, out from each tooth outer face 46. The wall of the wellbore 11 may either be cased or lined, such as with casing 12, or open hole.

As the downhole tractor 20 is conveying within the wellbore 11 or once the downhole tractor 20 reaches a destination in the wellbore 11, the downhole tool 18 may be operated to perform a downhole operation. For example, the downhole tool 18 may be, but is not limited to, a shifting tool, an explosive tool, a logging tool, a packer, the like, and/or any combination thereof and may perform the downhole operations of such tools.

Examples of the above embodiments include:

Example 1 is a downhole tractor assembly operable in a wellbore. The assembly includes a tractor body and a tractor wheel assembly, The tractor wheel assembly includes a tractor wheel comprising teeth around a circumference of the wheel and grooves between adjacent teeth that include an arced profile in a plane parallel with the axis of the wheel, and wherein each tooth includes an outer face comprising face grooves on each side of the outer face and that extend less than across the wheel.

In Example 2, the embodiments of any preceding paragraph or combination thereof further include wherein a pair of the face grooves is formed by an arced profile in a plane parallel with the axis of the wheel that extends past the outer face such that the face grooves extend less than across the wheel.

In Example 3, the embodiments of any preceding paragraph or combination thereof further include wherein the arced profiles of the grooves comprise a smallest radius of curvature that allows the grooves to extend across the wheel.

In Example 4, the embodiments of any preceding paragraph or combination thereof further include wherein the tractor wheel assembly further comprises an actuator assembly actionably coupled to the tractor body to extend and retract the tractor wheel.

In Example 5, the embodiments of any preceding paragraph or combination thereof further include wherein the assembly is operable to convey in an open hole wellbore.

In Example 6, the embodiments of any preceding paragraph or combination thereof further include wherein the grooves between adjacent teeth and the face grooves are shaped to channel debris out from the wheel as the wheel rotates against a wall of the wellbore.

In Example 7, the embodiments of any preceding paragraph or combination thereof further include wherein each of the outer surfaces comprise an area contact engageable with a wall of the wellbore.

In Example 8, the embodiments of any preceding paragraph or combination thereof further include wherein the grooves between each tooth comprise V-shaped grooves.

Example 9 is a method of operating a downhole tractor in a wellbore. The method includes engaging a wheel of the downhole tractor with a wall of the wellbore to grip the wall and rotating the wheel to engage outer faces of teeth around a circumference of the wheel and covey the downhole tractor within the wellbore. The method also includes displacing debris, as the wheel rotates, out from the wheel through grooves between adjacent teeth that include an arced profile parallel with the axis of the wheel. The method also includes displacing debris, as the wheel rotates, out from each tooth outer face through face grooves on each side of the outer face that extend less than across the wheel.

In Example 10, the embodiments of any preceding paragraph or combination thereof further include wherein a pair of the face grooves is formed by an arced profile parallel with the axis of the wheel that extends past the outer face such that the face grooves extend less than across the wheel.

In Example 11, the embodiments of any preceding paragraph or combination thereof further include wherein the arced profiles of the grooves comprise a smallest radius of curvature that allows the grooves to extend across the wheel In Example 12, the embodiments of any preceding paragraph or combination thereof further include wherein engaging the wheel with the wall comprises operating an actuator assembly that is part of the downhole tractor to extend the tractor wheel into engagement with the wall.

In Example 13, the embodiments of any preceding paragraph or combination thereof further include engaging the wheel with an open hole wall of the wellbore and conveying the downhole tractor within the open hole wellbore.

In Example 14, the embodiments of any preceding paragraph or combination thereof further include wherein each of the outer surfaces comprise an area contact engageable with a wall of the wellbore.

In Example 15, the embodiments of any preceding paragraph or combination thereof further include wherein the grooves between each tooth comprise V-shaped grooves.

Example 16 includes a downhole tractor wheel for use with a downhole tractor in a wellbore. The wheel includes teeth around a circumference of the wheel and grooves between adjacent teeth that include an arced profile parallel with the axis of the wheel. Each tooth includes an outer face including face grooves on each side of the outer face and that extend less than across the wheel.

In Example 17, the embodiments of any preceding paragraph or combination thereof further include wherein a pair of the face grooves is formed by an arced profile parallel with the axis of the wheel that extends past the outer face such that the face grooves extend less than across the wheel.

In Example 18, the embodiments of any preceding paragraph or combination thereof further include wherein the arced profiles of the grooves comprise a smallest radius of curvature that allows the grooves to extend across the wheel.

In Example 19, the embodiments of any preceding paragraph or combination thereof further include wherein each of the outer surfaces comprise an area contact.

In Example 20, the embodiments of any preceding paragraph or combination thereof further include wherein the grooves between each tooth comprise V-shaped grooves.

Certain terms are used throughout the description and claims to refer to particular features or components. As one skilled in the art will appreciate, different persons may refer to the same feature or component by different names. This document does not intend to distinguish between components or features that differ in name but not function.

For the embodiments and examples above, a non-transitory computer readable medium can comprise instructions stored thereon, which, when performed by a machine, cause the machine to perform operations, the operations comprising one or more features similar or identical to features of methods and techniques described above. The physical structures of such instructions may be operated on by one or more processors. A system to implement the described algorithm may also include an electronic apparatus and a communications unit. The system may also include a bus, where the bus provides electrical conductivity among the components of the system. The bus can include an address bus, a data bus, and a control bus, each independently configured. The bus can also use common conductive lines for providing one or more of address, data, or control, the use of which can be regulated by the one or more processors. The bus can be configured such that the components of the system can be distributed. The bus may also be arranged as part of a communication network allowing communication with control sites situated remotely from system.

In various embodiments of the system, peripheral devices such as displays, additional storage memory, and/or other control devices that may operate in conjunction with the one or more processors and/or the memory modules. The peripheral devices can be arranged to operate in conjunction with display unit(s) with instructions stored in the memory module to implement the user interface to manage the display of the anomalies. Such a user interface can be operated in conjunction with the communications unit and the bus. Various components of the system can be integrated such that processing identical to or similar to the processing schemes discussed with respect to various embodiments herein can be performed.

While compositions and methods are described herein in terms of "comprising" various components or steps, the compositions and methods can also "consist essentially of" or "consist of" the various components and steps.

Unless otherwise indicated, all numbers expressing quantities of ingredients, properties such as molecular weight, reaction conditions, and so forth used in the present specification and associated claims are to be understood as being modified in all instances by the term "about." Accordingly, unless indicated to the contrary, the numerical parameters set forth in the following specification and attached claims are approximations that may vary depending upon the desired properties sought to be obtained by the embodiments of the present invention. At the very least, and not as an attempt to limit the application of the doctrine of equivalents to the scope of the claim, each numerical parameter should at least be construed in light of the number of reported significant digits and by applying ordinary rounding techniques accepted by those skilled in the art.

The embodiments disclosed should not be interpreted, or otherwise used, as limiting the scope of the disclosure, including the claims. It is to be fully recognized that the different teachings of the embodiments discussed may be employed separately or in any suitable combination to produce desired results. In addition, one skilled in the art will understand that the description has broad application, and the discussion of any embodiment is meant only to be exemplary of that embodiment, and not intended to suggest that the scope of the disclosure, including the claims, is limited to that embodiment.

What is claimed is:

1. A downhole tractor assembly operable in a wellbore, comprising:

a tractor body; and a tractor wheel assembly comprising a wheel comprising teeth around a circumference of the wheel and grooves between adjacent teeth that include an arced profile in a plane parallel with an axis of the wheel, and wherein each tooth comprises an outer face comprising face grooves on each side of the outer face and that extend less than across the wheel.

2. The assembly of claim 1, wherein a pair of the face grooves is formed by an arced profile in a plane parallel with the axis of the wheel that extends past the outer face such that the face grooves extend less than across the wheel.

3. The assembly of claim 1, wherein the arced profiles of the grooves comprise a smallest radius of curvature that allows the grooves to extend across the wheel.

4. The assembly of claim 1, wherein the tractor wheel assembly further comprises an actuator assembly actionably coupled to the tractor body to extend and retract the tractor wheel.

5. The assembly of claim 1, wherein the assembly is operable to convey in an open hole wellbore.

6. The assembly of claim 1, wherein the grooves between adjacent teeth and the face grooves are shaped to channel debris out from the wheel as the wheel rotates against a wall of the wellbore.

7. The assembly of claim 1, wherein each of the outer faces comprises an area contact engageable with a wall of the wellbore.

8. The assembly of claim 1, wherein the grooves between each tooth comprise V-shaped grooves.

9. A method of operating a downhole tractor in a wellbore, comprising:

engaging a wheel of the downhole tractor with a wall of the wellbore to grip the wall;

rotating the wheel to engage outer faces of teeth around a circumference of the wheel and covey the downhole tractor within the wellbore;

displacing debris, as the wheel rotates, out from the wheel through grooves between adjacent teeth that include an arced profile parallel an axis of the wheel; and displacing debris, as the wheel rotates, out from each tooth outer face through face grooves on each side of the outer face that extend less than across the wheel.

10. The method of claim 9, wherein a pair of the face grooves is formed by an arced profile parallel with the axis of the wheel that extends past the outer face such that the face grooves extend less than across the wheel.

11. The method of claim 9, wherein the arced profiles of the grooves comprise a smallest radius of curvature that allows the grooves to extend across the wheel.

12. The method of claim 9, wherein engaging the wheel with the wall comprises operating an actuator assembly that is part of the downhole tractor to extend the tractor wheel into engagement with the wall.

13. The method of claim 9, further comprising engaging the wheel with an open hole wall of the wellbore and conveying the downhole tractor within the open hole wellbore.

14. The method of claim 9, wherein each of the outer faces comprises an area contact engageable with a wall of the wellbore.

15. The method of claim 9, wherein the grooves between each tooth comprise V-shaped grooves.

16. A downhole tractor wheel for use with a downhole tractor in a wellbore, comprising:

teeth around a circumference of the wheel; and grooves between adjacent teeth that include an arced profile parallel with an axis of the wheel; and wherein each tooth includes an outer face including face grooves on each side of the outer face and that extend less than across the wheel.

17. The wheel of claim 16, wherein a pair of the face grooves is formed by an arced profile parallel with the axis of the wheel that extends past the outer face such that the face grooves extend less than across the wheel.

18. The wheel of claim 16, wherein the arced profiles of the grooves comprise a smallest radius of curvature that allows the grooves to extend across the wheel.

19. The wheel of claim 16, wherein each of the outer faces comprises an area contact engageable with a wall of the wellbore.

20. The wheel of claim 16, wherein the grooves between each tooth comprise V-shaped grooves.

* * * * *